US008348254B2

(12) United States Patent
Mooney

(10) Patent No.: US 8,348,254 B2
(45) Date of Patent: Jan. 8, 2013

(54) CARPET PAD SEPARATOR

(76) Inventor: Robert Blu Mooney, Grand Rapids, MI (US)

( * ) Notice: Subject to any disclaimer, the term of this patent is extended or adjusted under 35 U.S.C. 154(b) by 134 days.

(21) Appl. No.: 12/806,305

(22) Filed: Aug. 10, 2010

(65) Prior Publication Data

US 2011/0031455 A1 Feb. 10, 2011

Related U.S. Application Data

(60) Provisional application No. 61/273,813, filed on Aug. 10, 2009.

(51) Int. Cl.
*B25B 9/04* (2006.01)
*B66F 3/00* (2006.01)

(52) U.S. Cl. ..... 269/47; 254/133 R

(58) Field of Classification Search ..... 81/485, 81/441, 442; 294/10, 12, 14, 26, 50.9; 254/10.5, 254/28, 133 R; 72/705, 479
See application file for complete search history.

(56) References Cited

U.S. PATENT DOCUMENTS

| | | | | | |
|---|---|---|---|---|---|
| 1,090,564 | A * | 3/1914 | Petersen | 81/15.2 |
| 1,722,953 | A * | 7/1929 | Cole | 294/10 |
| 1,742,727 | A * | 1/1930 | Richards | 294/14 |
| 1,832,606 | A * | 11/1931 | Zimmerman | 254/133 R |
| 3,622,191 | A * | 11/1971 | Nolley | 294/61 |
| 4,503,701 | A * | 3/1985 | Hardy | 72/372 |
| 4,706,358 | A * | 11/1987 | Johnson et al. | 29/235 |
| 5,346,268 | A * | 9/1994 | Baker et al. | 294/9 |
| D385,076 | S * | 10/1997 | Milbury | D34/10 |
| 6,543,270 | B2 * | 4/2003 | Cmelik | 72/478 |
| 2005/0252271 | A1 * | 11/2005 | Fredenberg et al. | 72/705 |

* cited by examiner

*Primary Examiner* — Lee D Wilson
*Assistant Examiner* — Jamal Daniel
(74) *Attorney, Agent, or Firm* — Kane & Co., PLC

(57) ABSTRACT

This invention concerns a carpet stand for lifting carpet, containing a rigid lift tip body along its long axis, further containing a support rod and a lifting tip. The lifting tip itself lies tangent to the exterior of the rigid lift tip's body, and perpendicular to its long axis, and is shaped such that it may grip or hold onto, into the backing of a carpet. The support rod itself is sized so that it may pass through the backing of a carpet. The support rod is then inserted down through the carpet such that the lift tip will grip and raise the carpet a distance sufficient to separate a carpet from its supporting surface.

19 Claims, 26 Drawing Sheets

FIG. 4
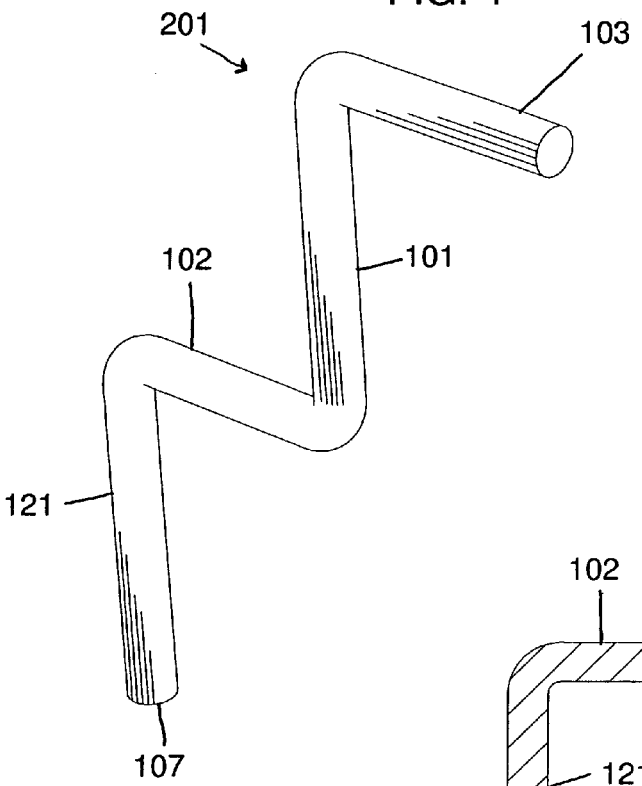
FIG. 6
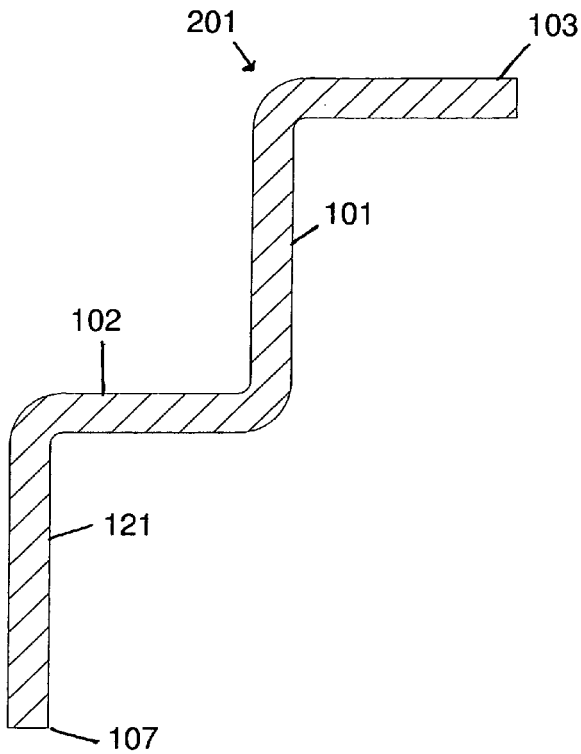
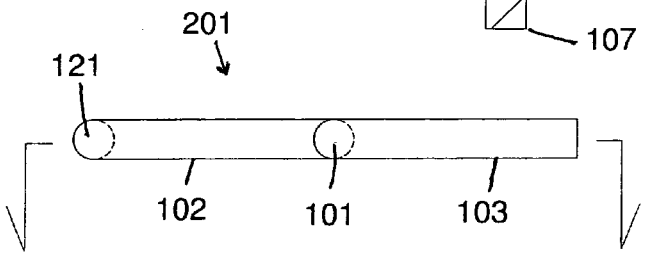
FIG. 5

FIG. 7
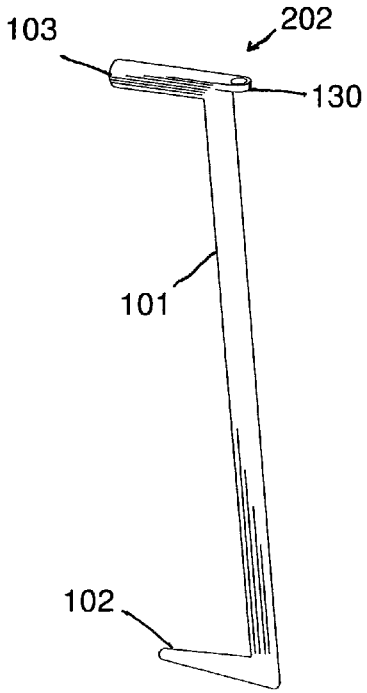
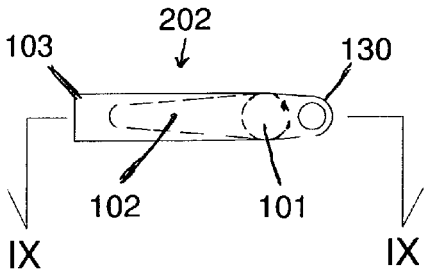
FIG. 8
FIG. 9
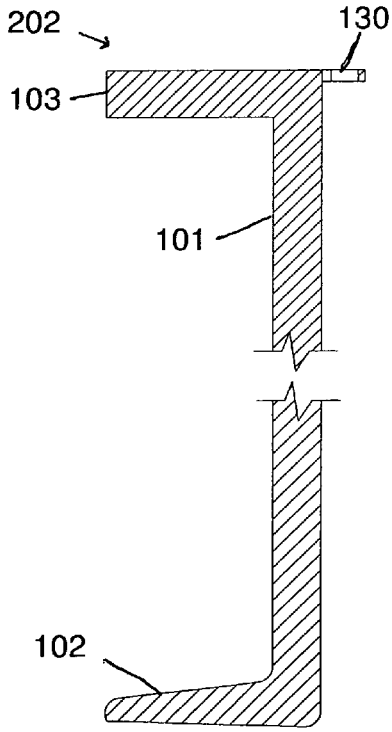

FIG. 10
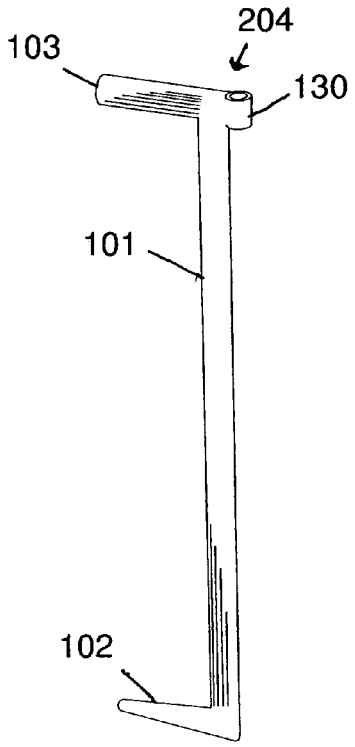
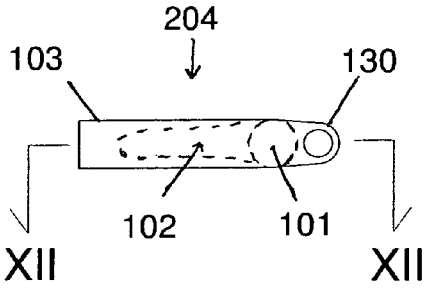
FIG. 11
FIG. 12
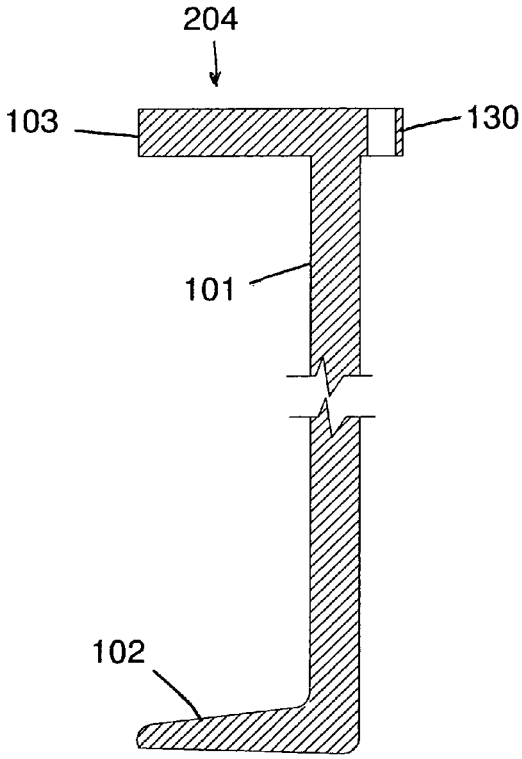

FIG. 13
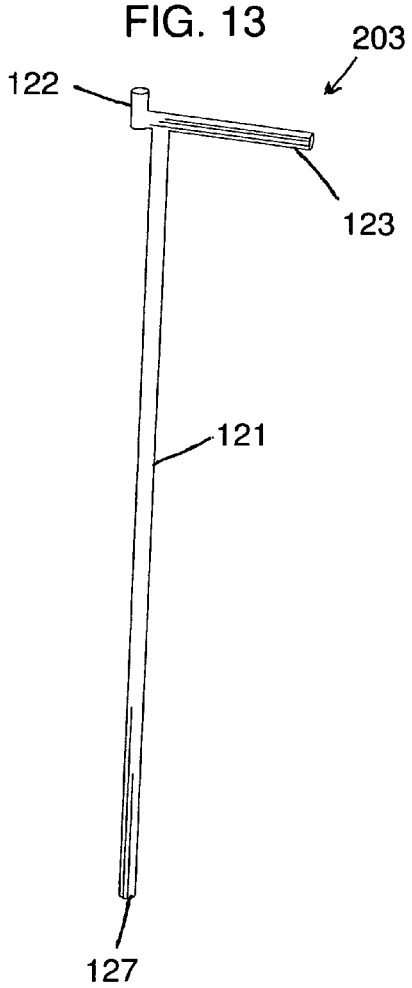
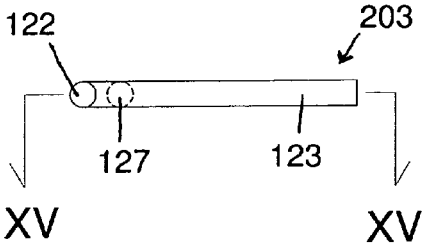
FIG. 14
FIG. 15
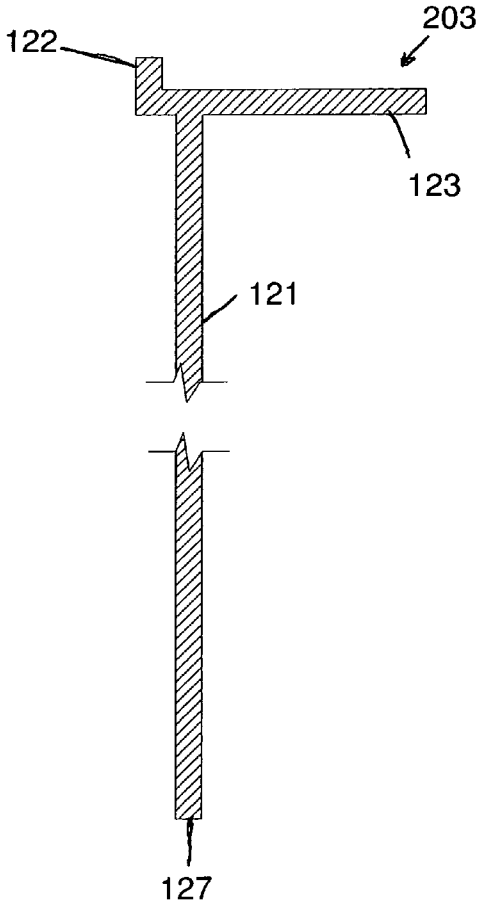

FIG. 16
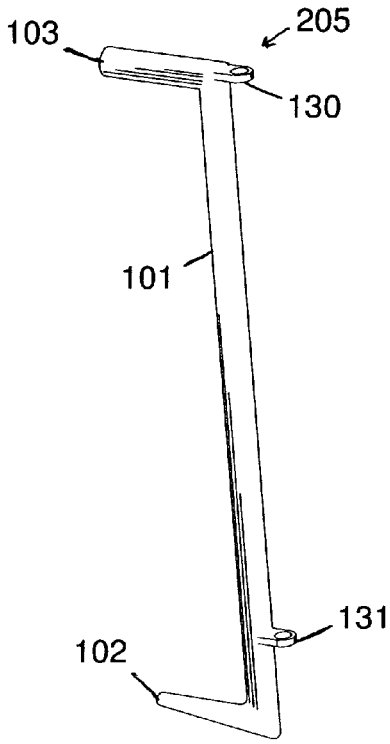
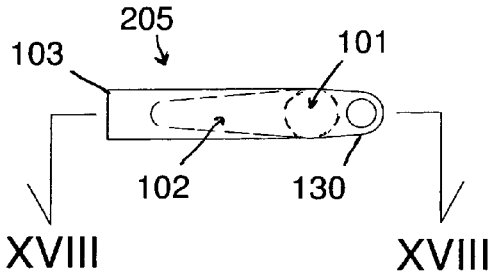
FIG. 17
FIG. 18
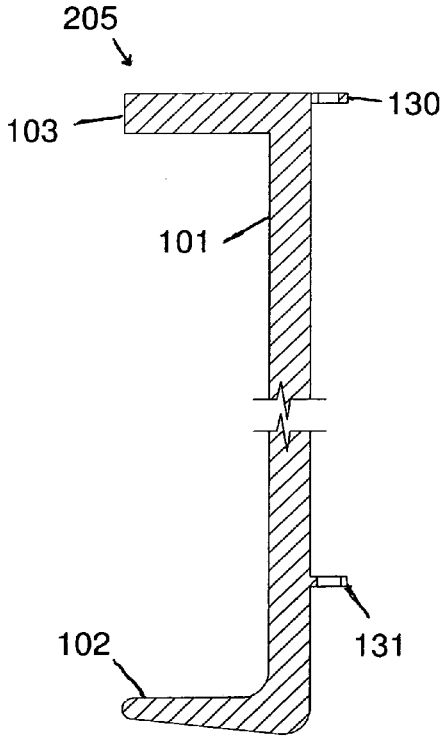

FIG. 19
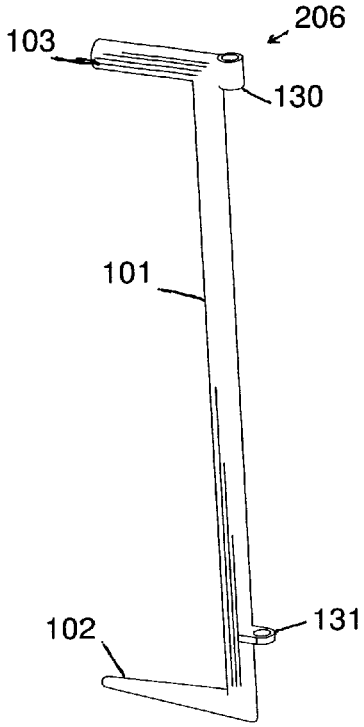
FIG. 21
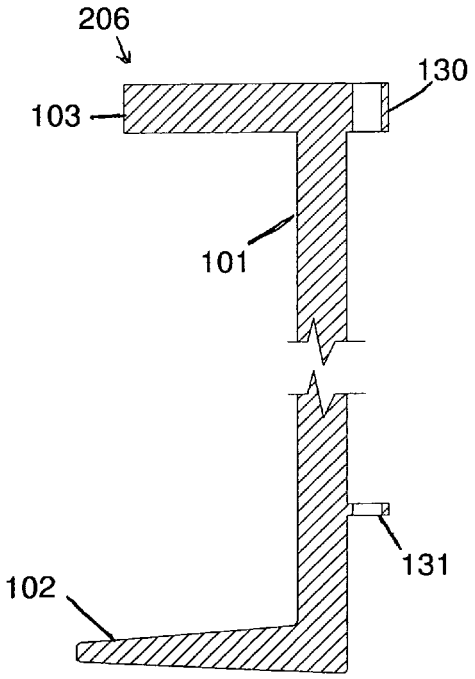
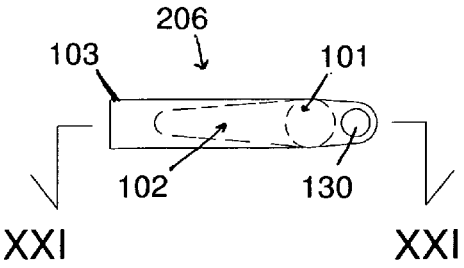
FIG. 20

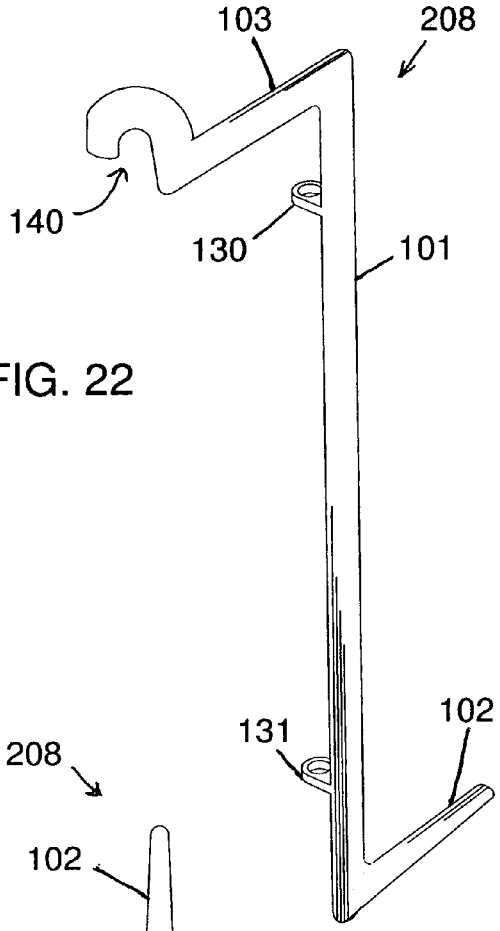
FIG. 22
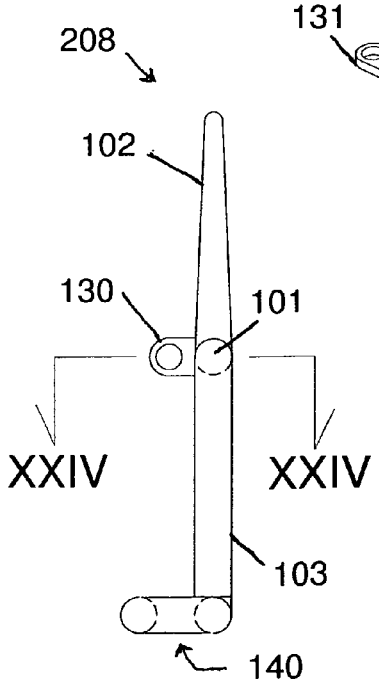
FIG. 23
FIG. 24
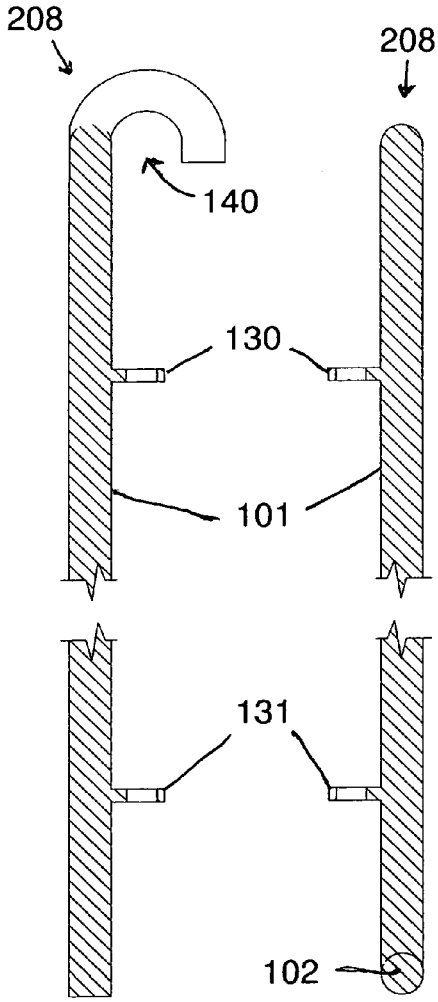
FIG. 25

FIG. 26
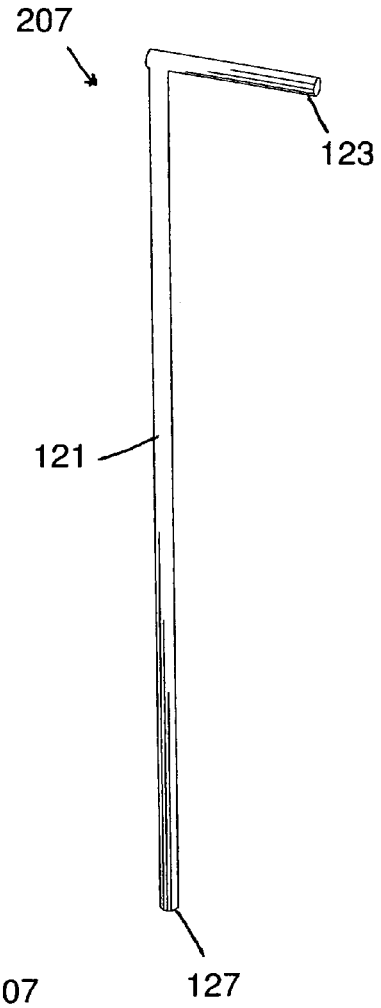
FIG. 28
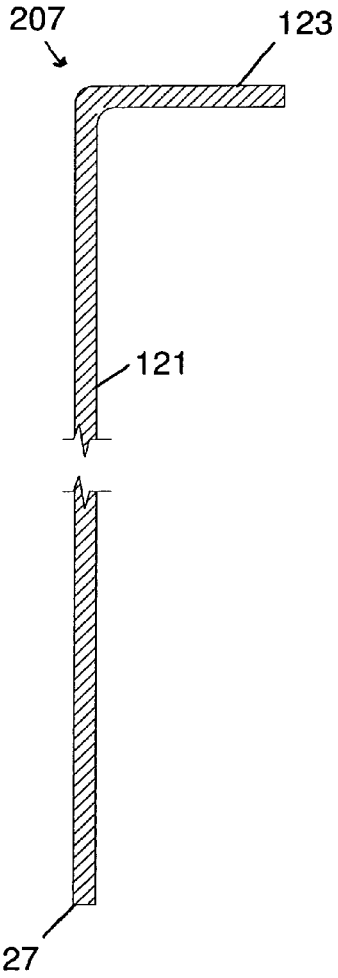
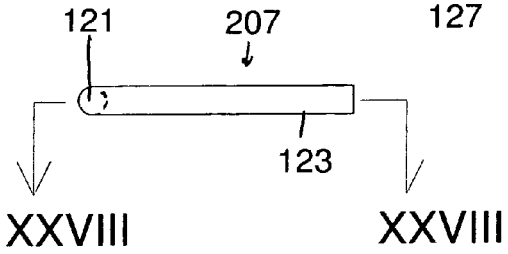
FIG. 27

FIG. 29
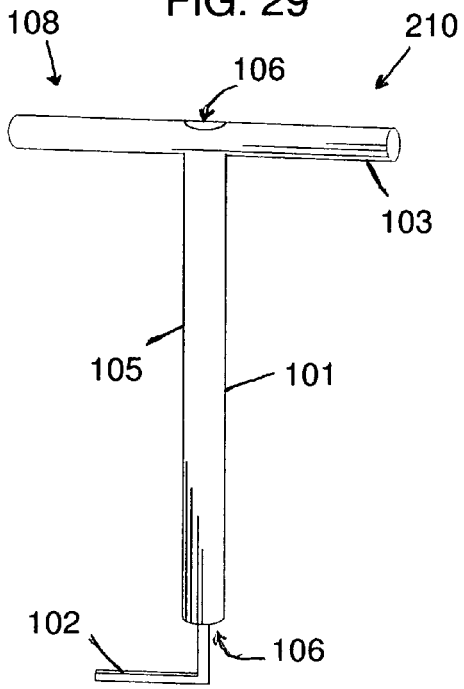
FIG. 31
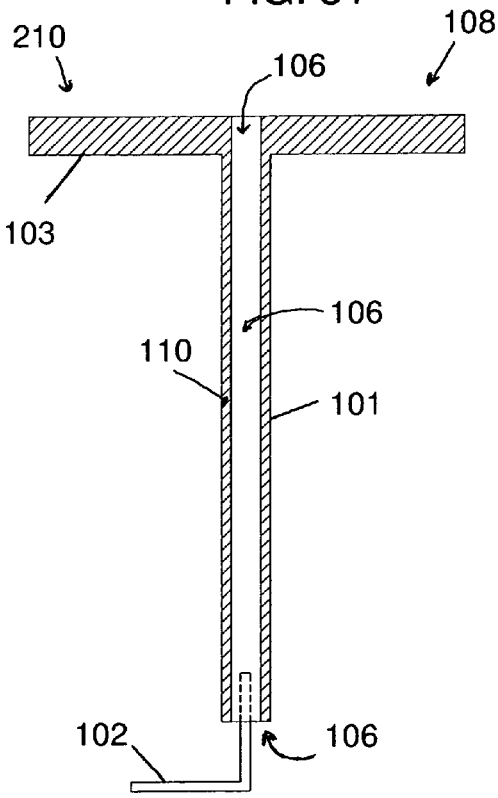
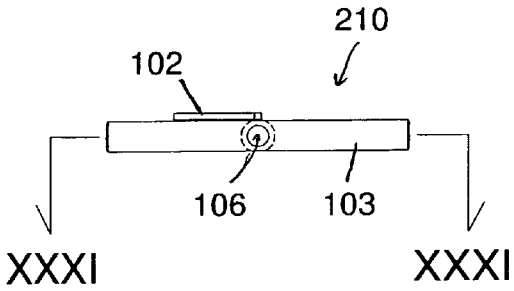
FIG. 30

FIG. 32
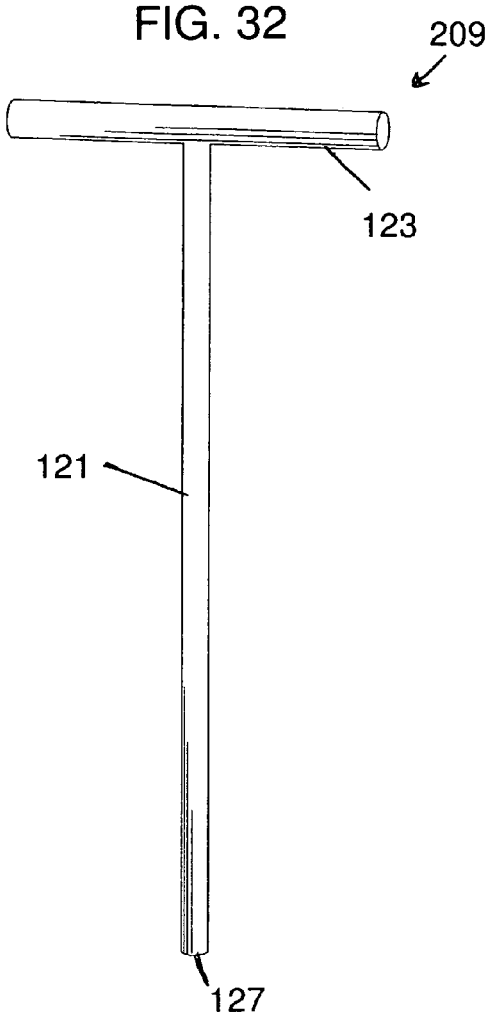
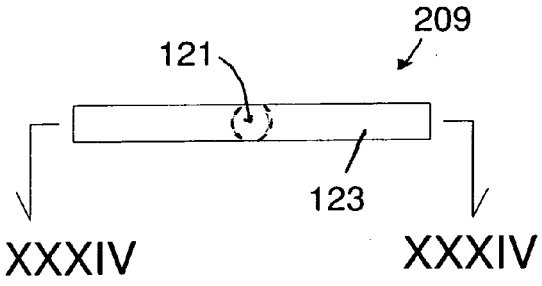
FIG. 33
FIG. 34
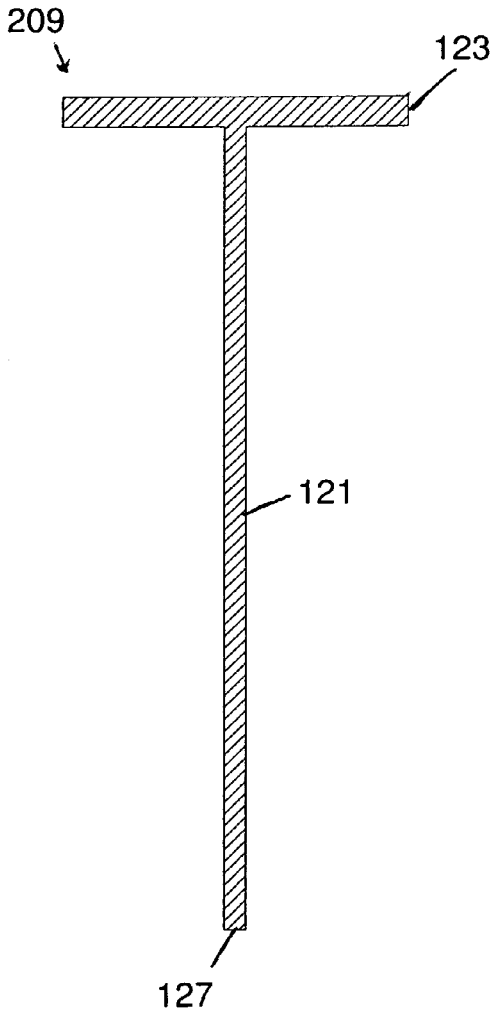

FIG. 35
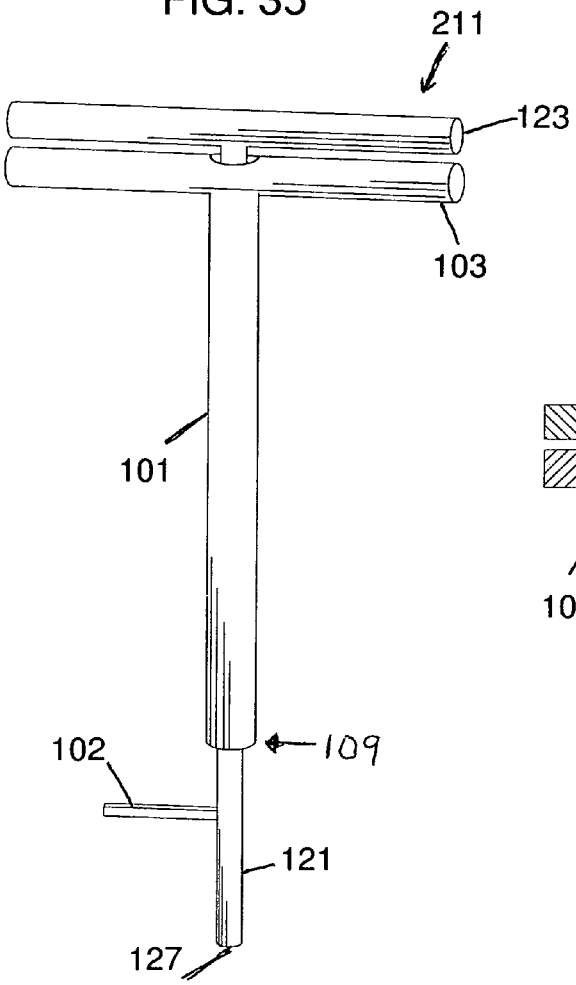
FIG. 37
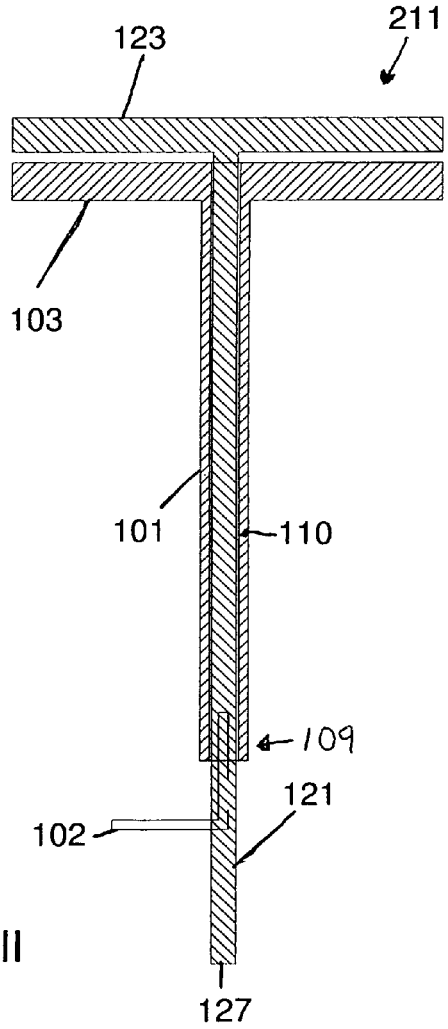
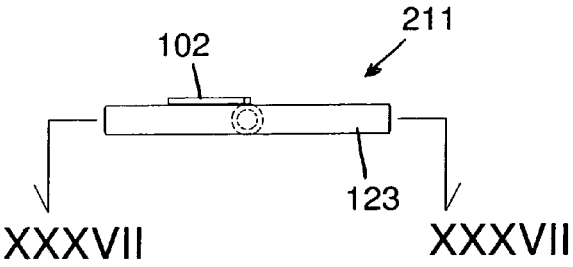
FIG. 36

FIG. 38
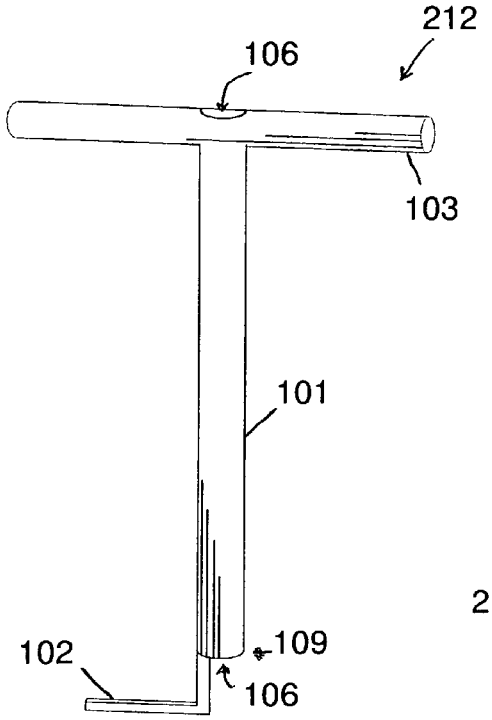
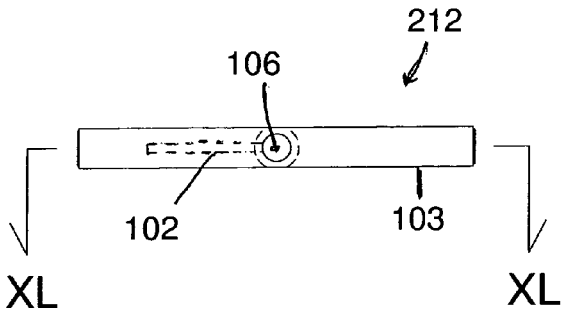
FIG. 39
FIG. 40
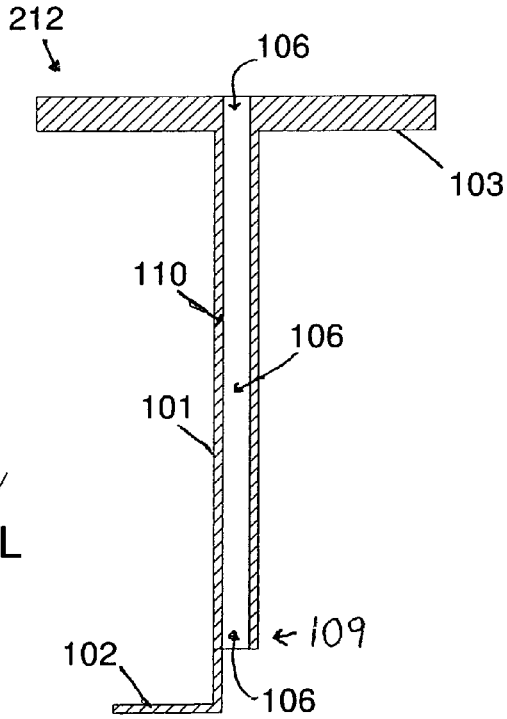

FIG. 41
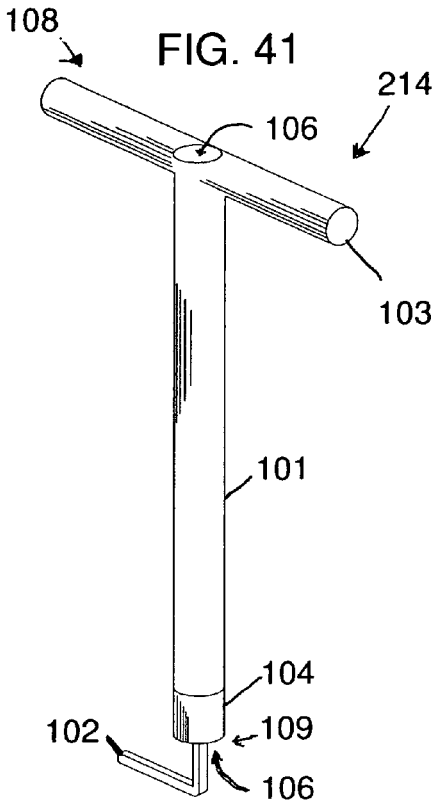
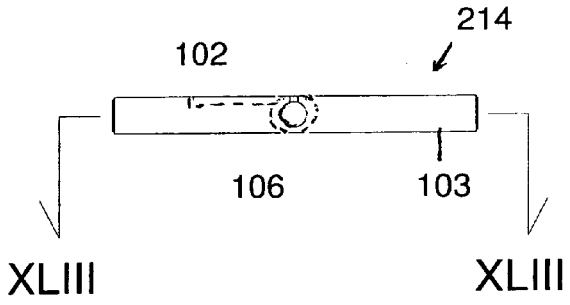
FIG. 42
FIG. 43
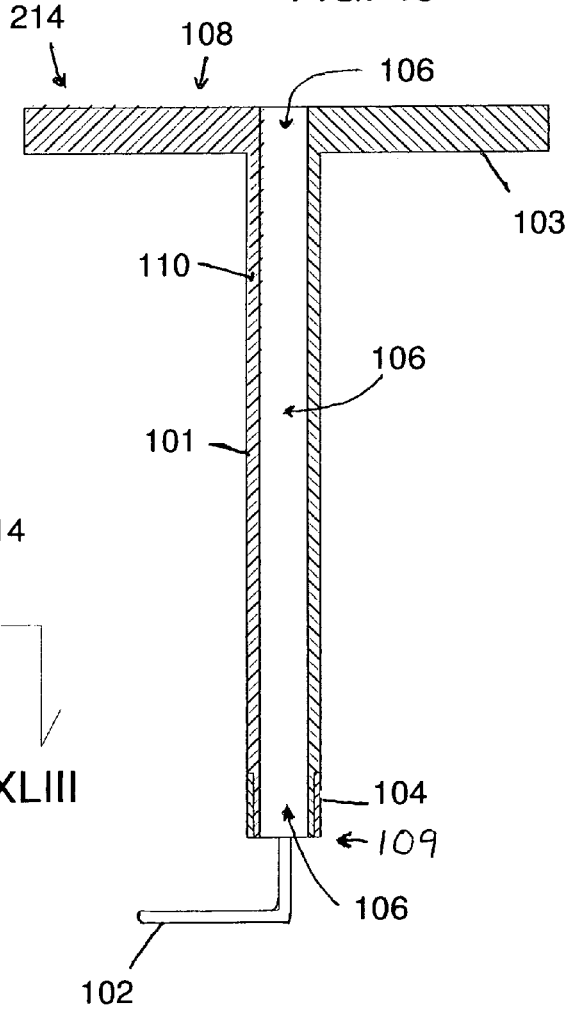

FIG. 47
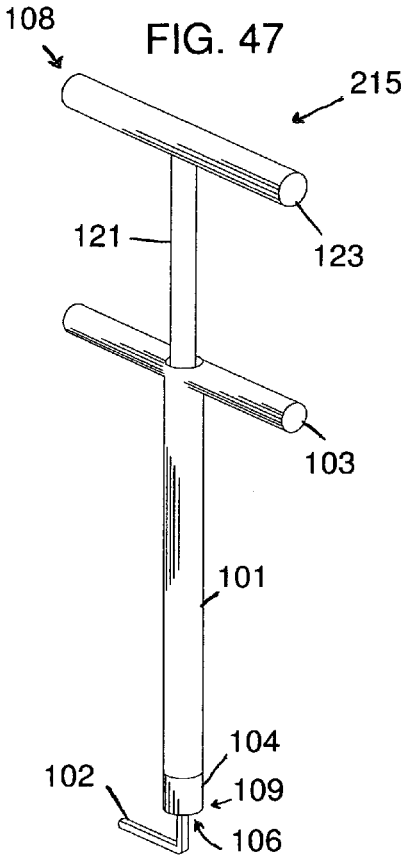
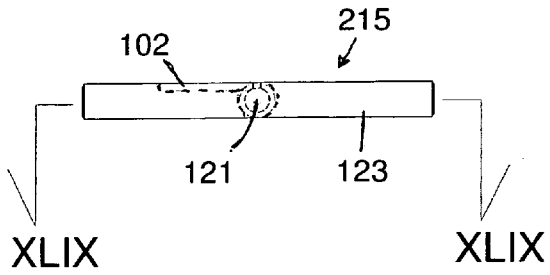
FIG. 48
FIG. 49
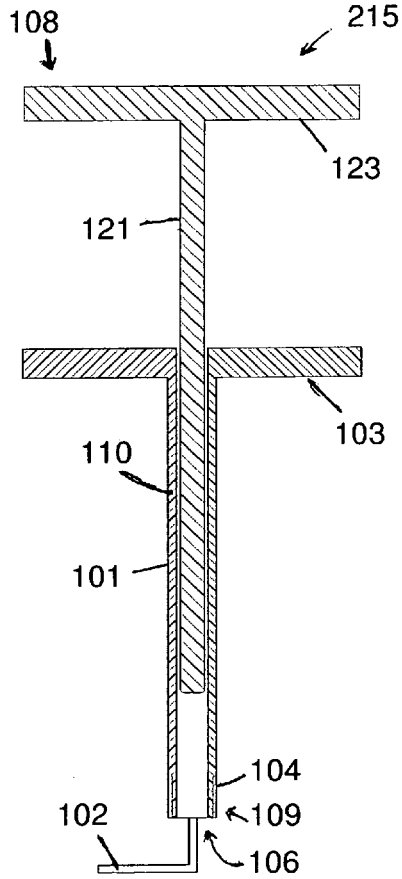

FIG. 50
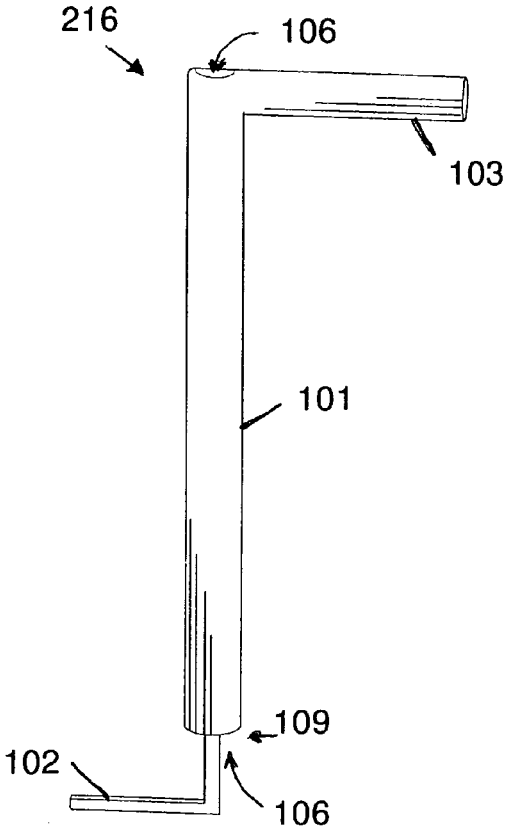
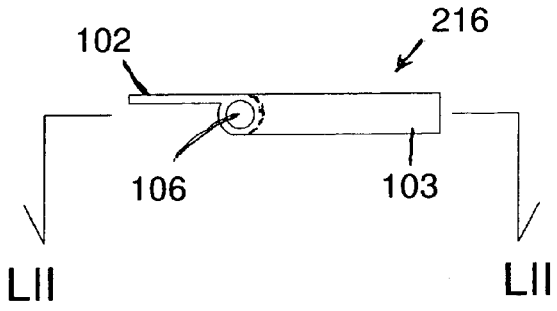
FIG. 51
FIG. 52
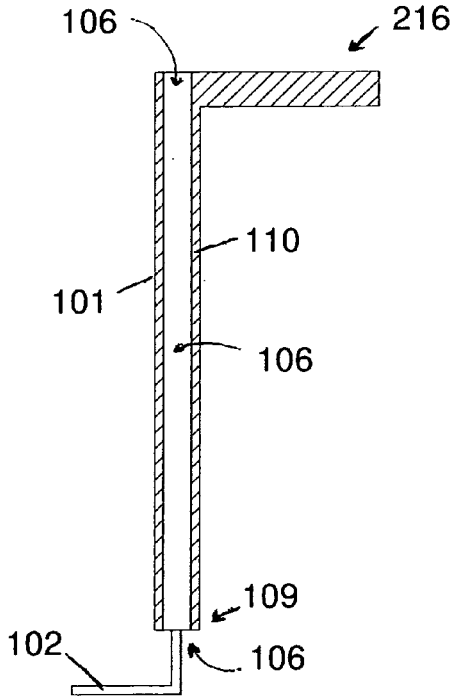

FIG. 53
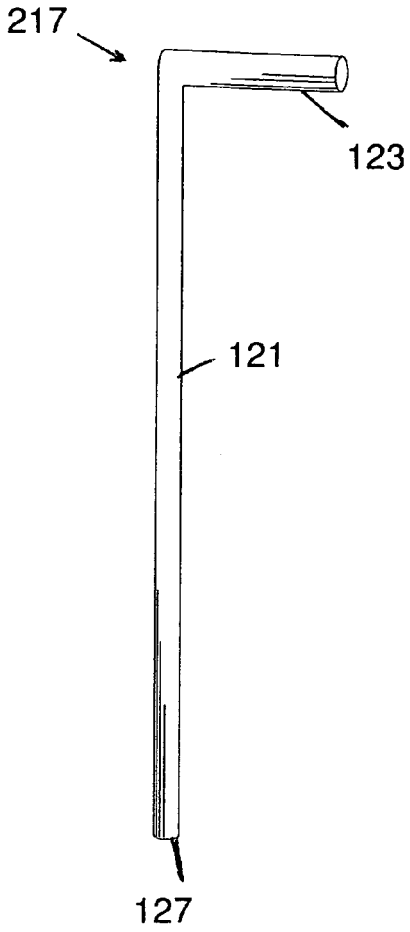
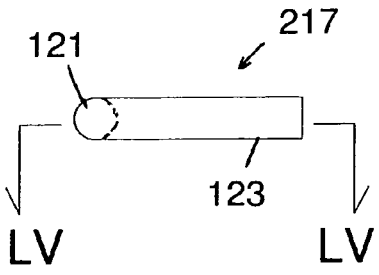
FIG. 54
FIG. 55
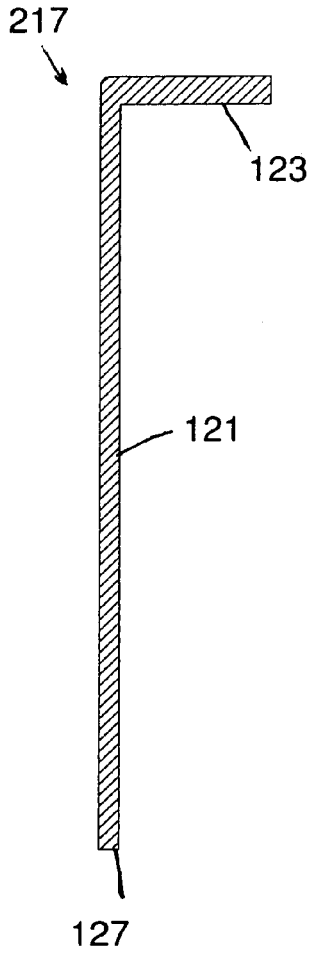

FIG. 56
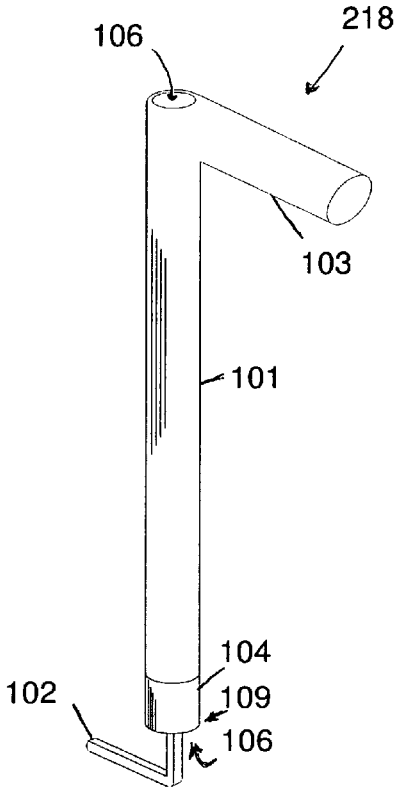
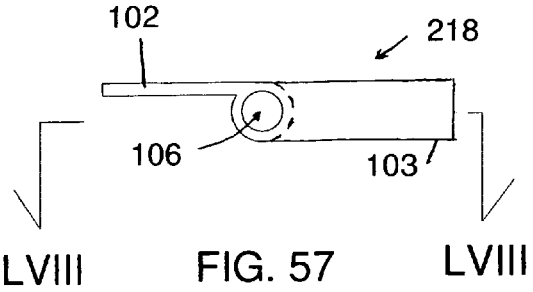
FIG. 57
FIG. 58
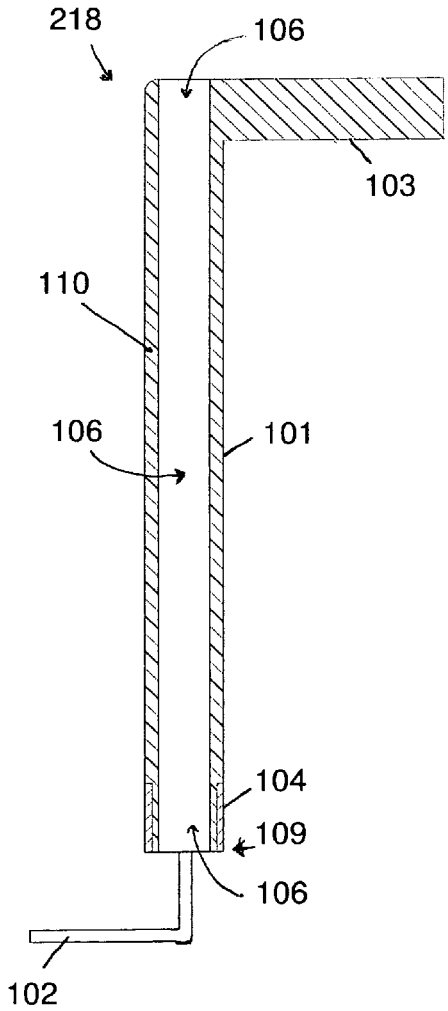

FIG. 59
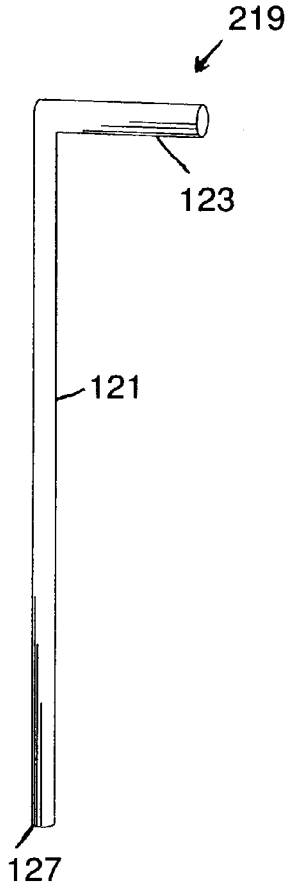
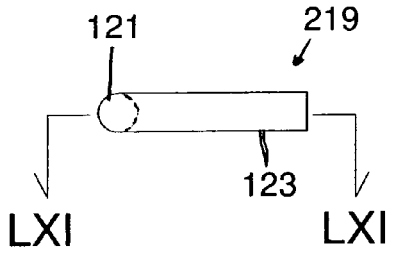
FIG. 60
FIG. 61
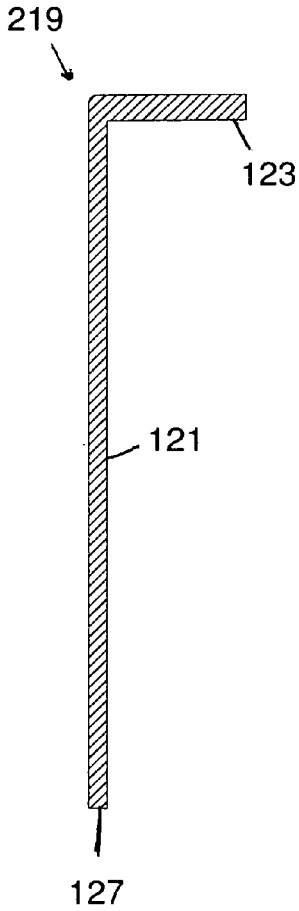

FIG. 62
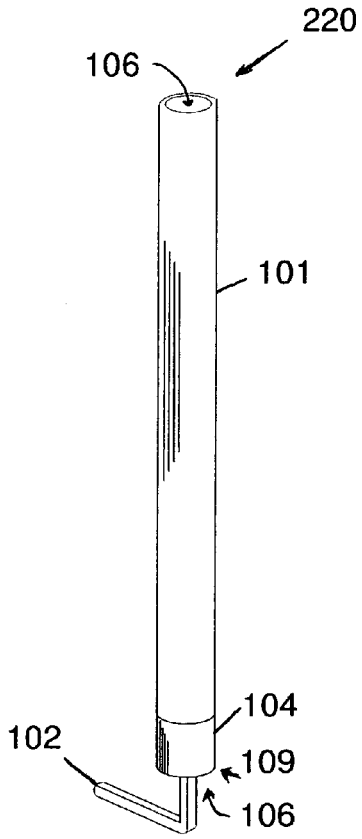
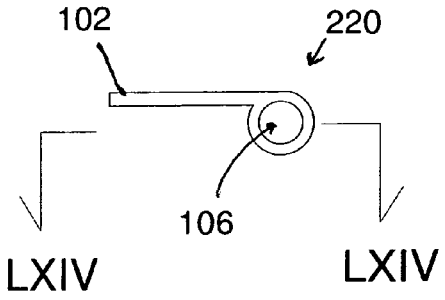
FIG. 63
FIG. 64
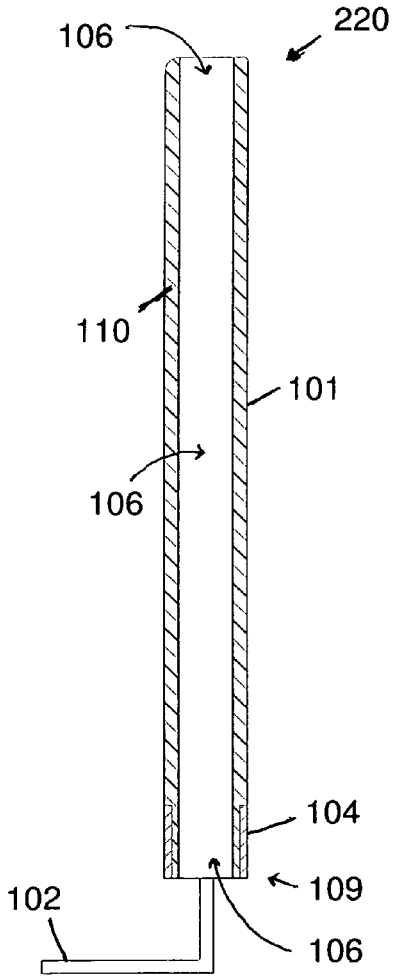

FIG. 65
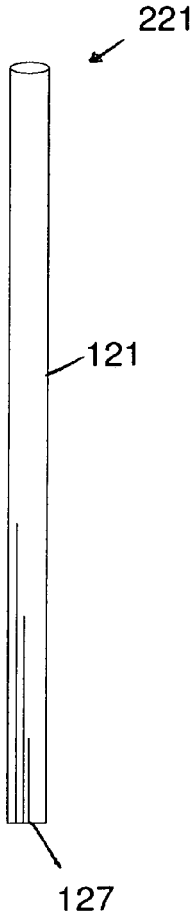
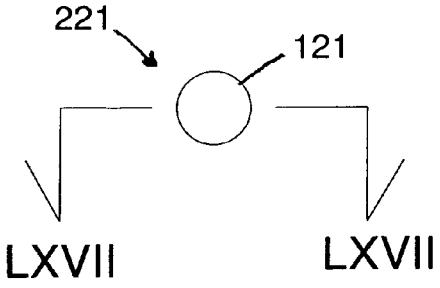
FIG. 66
FIG. 67
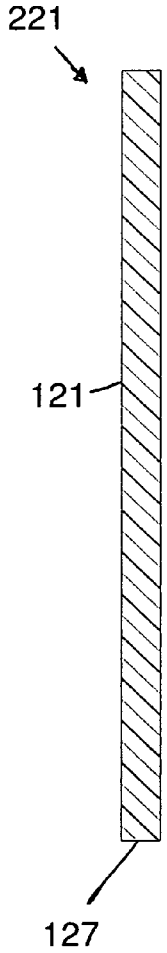

CARPET PAD SEPARATOR

CROSS REFERENCE TO RELATED APPLICATION

This Non provisional application is a continuation from U.S. provisional application 61/273,813 filed Aug. 10, 2009

STATEMENT REGARDING FEDERALLY SPONSORED RESEARCH OR DEVELOPMENT

Not Applicable

BACKGROUND OF THE INVENTION

Field of the Invention

This invention relates to carpet and carpet pad and more particularly to a device that creates a separation between installed carpet and the pad. More specifically the invention is a tool that is used on installed carpet to create a separation between the carpet and pad. More specifically the tool is applied just after the carpet has been cleaned or steam cleaned to create said air gap separation.

Every year thousands of consumers are faced with spots in there carpet. Consumers may have there carpets cleaned by a carpet cleaning company or may choose to clean the carpet themselves. Stains and spots in carpets often return after cleaning the carpets due to the stain transferring up from the pad. As the carpet and pad dry, the stain wicks up from the pad into the carpet again resulting in the stain or spot to return.

Traditionally consumers have to accept that the stain has returned or may opt to have the carpet and pad replaced. Carpet cleaning companies may offer a return visit to work on the spots that return but cannot guarantee that they will not return again. These return visits can get expensive and is time and labor consuming.

There has been a long felt yet unresolved need to provide a solution for this problem.

SUMMARY OF THE INVENTION

The invention described below overcomes all of the disadvantages of what was done prior to the invention. The invention substantially reduces the need for carpet cleaners to return to re-clean stains and spots that return. This invention reduces carpet cleaners cost of time, labor, and machine wear and tear. This invention enables people to keep carpet looking better and longer.

A carpet stand device is provided to achieved a separation or air gap between the carpet and the pad. The carpet stand enables the carpet and pad to dry without touching each other. The invention is designed and intended to create the air gap separation and sustain the air gap separation until the carpet stand is removed. This invention is designed to stop carpet wicking when the pad and carpet dry together in contact with each other.

The carpet stand device comprises a shaft with a 90 degree angle on one end and a handle grip at opposing end. A second shaft rides parallel to the first shaft with the 90 degree end. The second shaft will slide on the inside and parallel to the 90 degree shaft, or on the outside but still parallel to the 90 degree shaft. The 90 degree tip end is inserted through an opening between the carpet fibers. While the 90 degree tip is through the carpet backing the shaft is rotated to the upright position. The second shaft is now inserted and a latch or mechanism is used to sustain the second shafts projection farther than and past the 90 degree angle end to create the air gap between the carpet and pad.

The stop latch mechanism may be located on either of these shafts. Its purpose is that the inner or parallel shaft is to stick out past the 90 degree angle end and sustain the projection until the release of the stop latch mechanism allowing the second shaft to retract. The embodiment of the utility tool may be made of solid or tubular construction or any combination or any different materials such as any formulations of steels or plastics to be determined.

According to another form of the invention, the carpet stand is simplified to a one piece carpet stand to create the air gap. For example the 90 angle and the shaft and handle are of the same one piece body. The carpet is lifted and carpet stand is inserted and shifted into position to create said air gap.

According to another form of the invention, The carpet stand is simplified to a second design of the one piece embodiment to create the air gap. For example the 90 angle and the shaft and handle are of the same one piece body. The carpet is lifted and carpet stand is inserted and turned into position to create said air gap.

According to another form of the invention, the carpet stand is designed to be used one time and then discarded, while another form of the carpet stand is reusable multiple times.

One advantage provided by the invention is that carpets can dry independent of the pad which substantially reduces the stain or spot from returning. Another advantage is carpet cleaning companies will not have as many call backs due to stains and spots that return. Another advantage is that when carpets are made to stay cleaner, they look better which enables carpet to be kept longer and last longer. Another advantage is that apartment complexes and landlords etc will be able to take advantage of the carpet stand to save money.

These and other advantages of the instant invention will become understood and readily apparent to a person of ordinary skill in the art after reading the following detailed description in combination with reference to the following figures.

DESCRIPTION OF THE DRAWING FIGURES

FIG. 4 is an oblique view of another form of the carpet stand comprising the invention;

FIG. 5 is a top view of the invention shown in FIG. 4;

FIG. 6 is a cross-sectional view of the invention taken along line VI-VI shown in FIG. 5;

FIG. 7 is an oblique view of yet another form of the carpet stand comprising the invention;

FIG. 8 is a top view of the invention shown in FIG. 7;

FIG. 9 is a cross-sectional view of the invention taken along line IX-IX shown in FIG. 8;

FIG. 10 is an oblique view of yet another form of the carpet stand comprising the invention;

FIG. 11 is a top view of the invention shown in FIG. 10;

FIG. 12 is a cross-sectional view of the invention taken along line XII-XII shown in FIG. 8;

FIG. 13 is an oblique view of yet another form of the carpet stand comprising the invention;

FIG. 14 is a top view of the invention shown in FIG. 13;

FIG. 15 is a cross-sectional view of the invention taken along line XV-XV shown in FIG. 14;

FIG. 16 is an oblique view of another form of the invention;

FIG. 17 is a top view of the invention shown in FIG. 16;

FIG. 18 is a cross-sectional view of the invention taken along line XVIII-XVIII shown in FIG. 17;

FIG. 19 is an oblique view of yet another form of the carpet stand comprising the invention;

FIG. 20 is a top view of the invention shown in FIG. 19;

FIG. 21 is a cross-sectional view of the invention taken along line XXI-XXI shown in FIG. 20;

FIG. 22 is an oblique view of another form of the invention;

FIG. 23 is a top view of the invention shown in FIG. 22;

FIG. 24 is a cross-sectional view of the invention taken along line XXIV-XXIV shown in FIG. 23;

FIG. 25 is the opposing cross-sectional view of the invention taken along line XXIV-XXIV shown in FIG. 23;

FIG. 26 is an oblique view of yet another form of the carpet stand comprising the invention;

FIG. 27 is a top view of the invention shown in FIG. 26;

FIG. 28 is a cross-sectional view of the invention taken along line XXVIII-XXVIII shown in FIG. 27;

FIG. 29 is an oblique view of another form of the invention;

FIG. 30 is a top view of the invention shown in FIG. 29;

FIG. 31 is a cross-sectional view of the invention taken along line XXXI-XXXI shown in FIG. 30;

FIG. 32 is an oblique view of yet another form of the carpet stand comprising the invention;

FIG. 33 is a top view of the invention shown in FIG. 32;

FIG. 34 is a cross-sectional view of the invention taken along line XXXIV-XXXIV shown in FIG. 33;

FIG. 35 is an oblique view of another form of the invention;

FIG. 36 is a top view of the invention shown in FIG. 35;

FIG. 37 is a cross-sectional view of the invention taken along line XXXVII-XXXVII shown in FIG. 36;

FIG. 38 is an oblique view of another form of the invention;

FIG. 39 is a top view of the invention shown in FIG. 38;

FIG. 40 is a cross-sectional view of the invention taken along line XL-XL shown in FIG. 39;

FIG. 41 is an oblique view of yet another form of the carpet stand comprising the invention;

FIG. 42 is a top view of the invention shown in FIG. 41;

FIG. 43 is a cross-sectional view of the invention taken along line XLIII-XLIII shown in FIG. 42;

FIG. 47 is an oblique view of yet another form of the carpet stand comprising the invention;

FIG. 48 is a top view of the invention shown in FIG. 47;

FIG. 49 is a cross-sectional view of the invention taken along line XLIX-XLIX shown in FIG. 48;

FIG. 50 is an oblique view of another form of the invention;

FIG. 51 is a top view of the invention shown in FIG. 50;

FIG. 52 is a cross-sectional view of the invention taken along line LII-LII shown in FIG. 51;

FIG. 53 is an oblique view of yet another form of the carpet stand comprising the invention;

FIG. 54 is a top view of the invention shown in FIG. 53;

FIG. 55 is a cross-sectional view of the invention taken along line LV-LV shown in FIG. 54;

FIG. 56 is an oblique view of another form of the invention;

FIG. 57 is a top view of the invention shown in FIG. 56;

FIG. 58 is a cross-sectional view of the invention taken along line LVIII-LVIII shown in FIG. 57;

FIG. 59 is an oblique view of yet another form of the carpet stand comprising the invention;

FIG. 60 is a top view of the invention shown in FIG. 59;

FIG. 61 is a cross-sectional view of the invention taken along line LXI-LXI shown in FIG. 60;

FIG. 62 is an oblique view of another form of the invention;

FIG. 63 is a top view of the invention shown in FIG. 62;

FIG. 64 is a cross-sectional view of the invention taken along line LXIV-LXIV shown in FIG. 63;

FIG. 65 is an oblique view of another form of the invention;

FIG. 66 is a top view of the invention shown in FIG. 65;

FIG. 67 is a cross-sectional view of the invention taken along line LXVII-LXVII shown in FIG. 66;

DETAILED DESCRIPTION OF THE INVENTION

Figure 1:
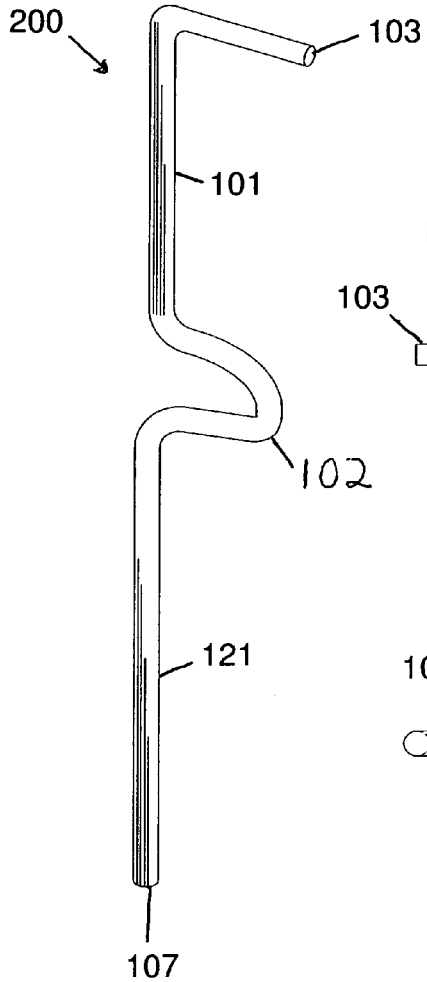
FIG. 1 is an oblique view of one form of the carpet stand comprising the invention.

For purposes of the following description, the terms "upper," "lower," "right," "left," "rear," "front," "vertical," "horizontal," "inclined." and derivatives thereof shall relate to the invention as oriented as in FIG. 49. However, it is to be understood that the invention may assume various alternative orientations and component spacing, except where expressly specified to the contrary. It is also to be understood that the specific devices and processes illustrated in the attached drawings and described in the following specification are simply exemplary embodiments of the inventive concepts defined in the appended claims. Hence specific dimensions and other physical characteristics relating to the embodiments disclosed herein are not to be considered as limiting, unless the claims expressly state otherwise. Moreover, in reference to the drawing figures, like numerals will be used in the different views to illustrate similar components.

Referring to the drawing figures, the different embodiments shown therein generally illustrate a device used after some carpet has been cleaned or steam cleaned. The device is then utilized to sustain an air gap separation between the carpet and the pad to assist drying and stop carpet wicking in the user's desired locations. The carpet stand may be used on a wide variety of carpets and pads. The invention also virtually eliminates the need for professional carpet cleaning services to have to return to re-clean stains and spots that come back after the carpets have dried.

Figure 45:
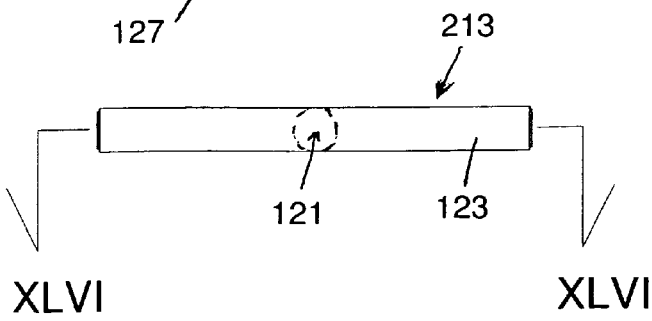
FIG. 45 is a top view of the invention shown in FIG. 44.
Figure 46:
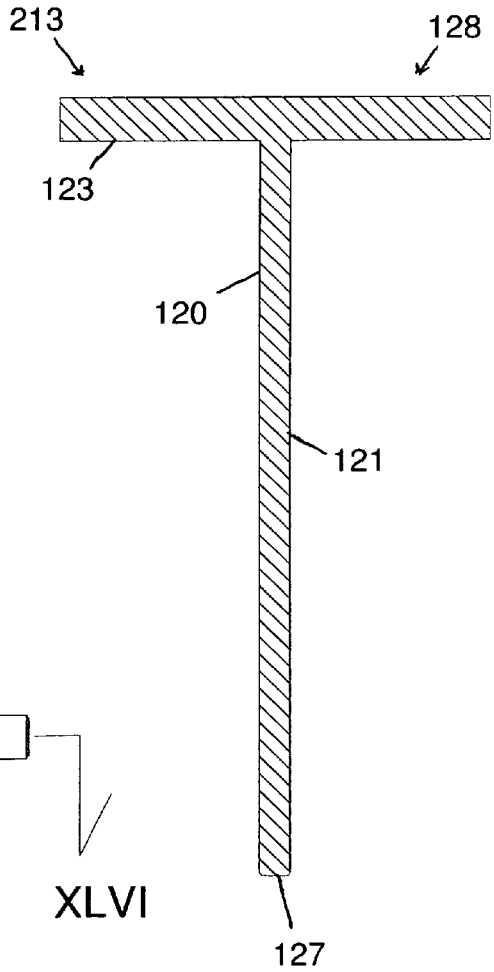
FIG. 46 is a cross-sectional view of the invention taken along line XLVI-XLVI shown in FIG. 45.
Figure 68:
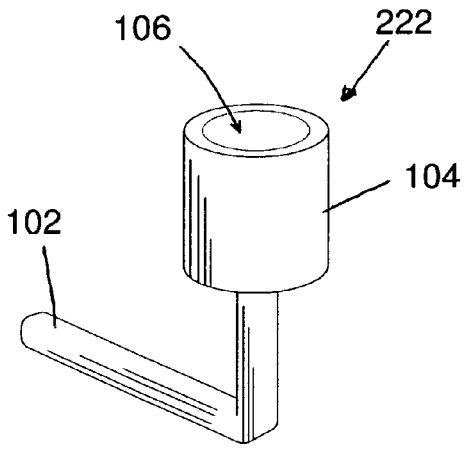
FIG. 68 is an oblique view of yet another form of the carpet stand comprising the invention.
Figure 70:
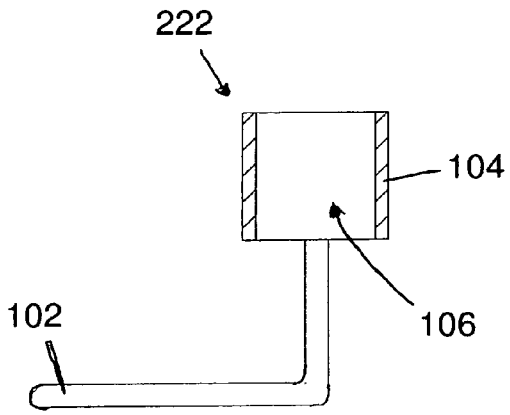
FIG. 70 is a cross-sectional view of the invention taken along line LXX-LXX shown in FIG. 69.
Figure 69:
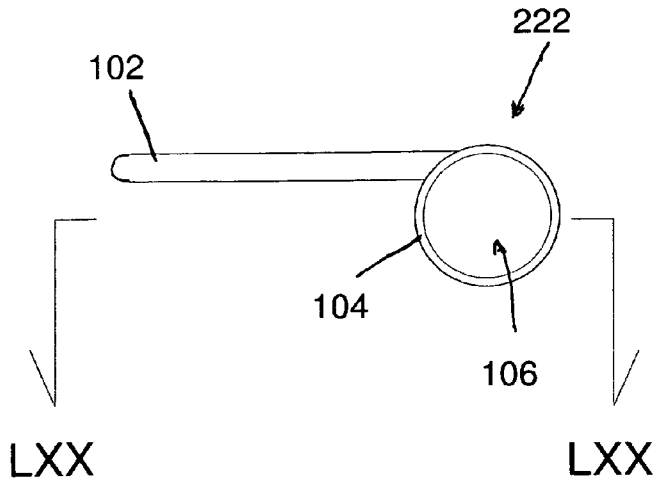
FIG. 69 is a top view of the invention shown in FIG. 68.
Figure 71:
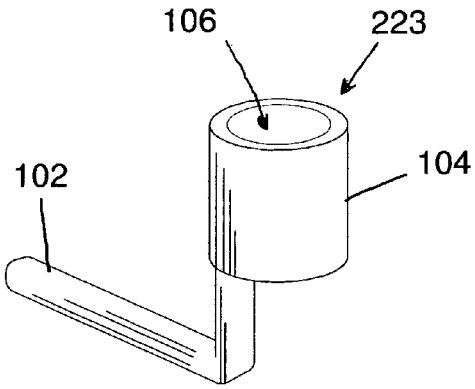
FIG. 71 is an oblique view of another form of the invention.
Figure 73:
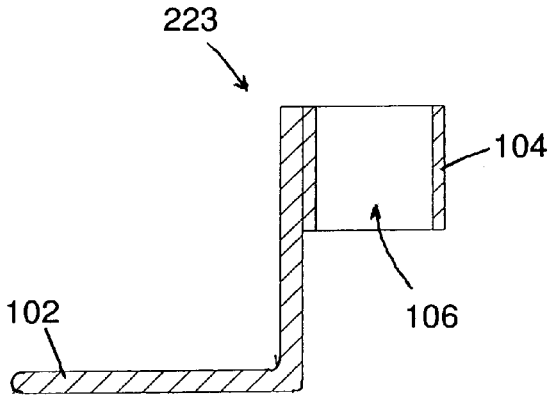
FIG. 73 is a cross-sectional view of the invention taken along line LXXIII-LXXIII shown in FIG. 72.
Figure 72:
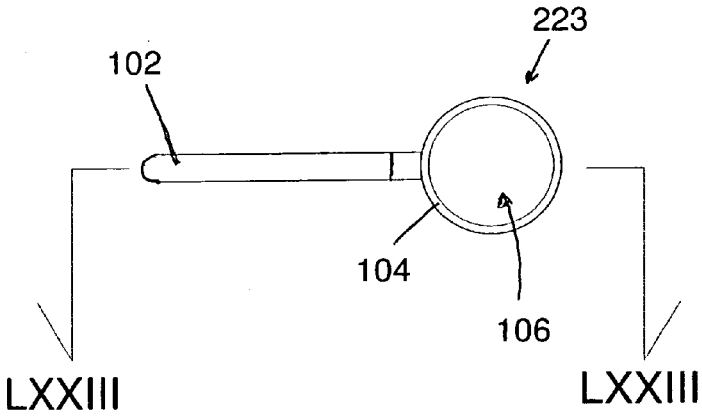
FIG. 72 is a top view of the invention shown in FIG. 71.
Figure 74:
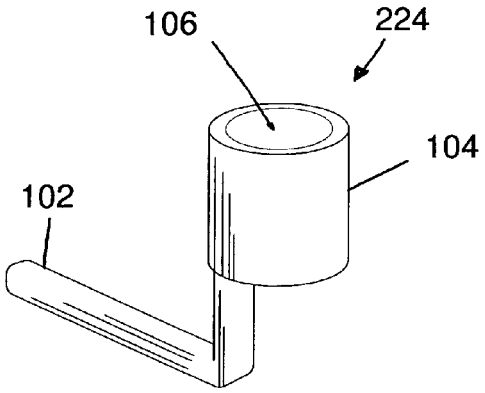
FIG. 74 is an oblique view of yet another form of the carpet stand comprising the invention.
Figure 76:
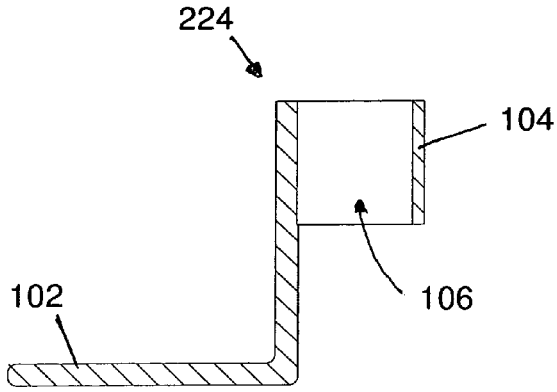
FIG. 76 is a cross-sectional view of the invention taken along line LXXVI-LXXVI shown in FIG. 75.
Figure 75:
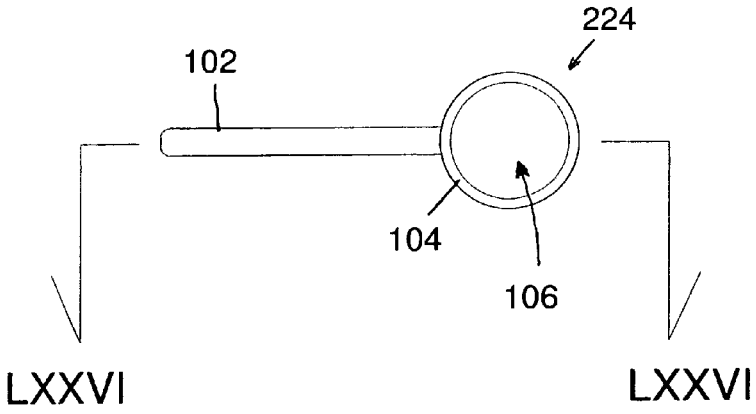
FIG. 75 is a top view of the invention shown in FIG. 74.

According to one form of the invention illustrated in FIGS. 47-49, a carpet stand for carpet and pad comprises a generally tubular body 101 having a carpet lift tip on one end 102 and a body handle 103 at the opposing end. The tubular body 101 is shown as being substantially cylindrical, although a polygonal-shape or faceted shape would also be acceptable. It is envisioned that the shapes and sizes may range from cylindrical to triangular in cross section. The carpet pap separator may be made from any one of a number of materials including metals, plastics, including thermoplastics and thermosetting resins injected or from a mold which may include various colors which show contrast and location when in use on carpet and may even be transparent or even to have a colored transparency. The carpet pad separator is envisioned in some embodiments to be solid material and in some embodiments to have a concentric cavity along the longitudinal axis of the tubular body and extending through both ends. A preferred quality and characteristic of the material is that it be substantially impermeable to fluids and more specifically carpet cleaning solutions. Any one of a number of materials may be used to form the carpet pad separator so long as the material can provide a rigid sidewall 110 to define a cavity 106 between the bottom end of the lift tip body and more specifically at the lift tip end of the housing 109 to the opposing end of the body on the top at cavity 106 of the body handle 103 The body handle 103 and the lift tip 102 is generally at a right angle to the cylindrical lift tip body 101 The lift tip 102 and tip body 104 may be constructed as a separate piece or part and then attached with the lift tip body 101 of an alternative material or may be formed as part of the lift tip body 101 as one piece unit using the same material. In the support rod embodiment in FIGS. 44-46 the support rod 213 has a substantially cylindrical solid rod like embodiment. Between the support rod tip 127 to opposing end 128 the handle 123 on the top end 128 is generally at a right angle to the support rod shaft 121 The handle 123 may be in the form of an L-shape shown in FIG. 53 or a T-shape as pictured in conjunction with the lift tip body in FIG. 47 The lift tip embodiment in FIGS. 41-43 is used in conjunction with the support rod embodiment in FIGS. 44-46 The support rod tip 127 is inserted in into the body handle cavity 106 and is intended to resemble the orientation of the embodiment in FIG. 47

Figure 44:
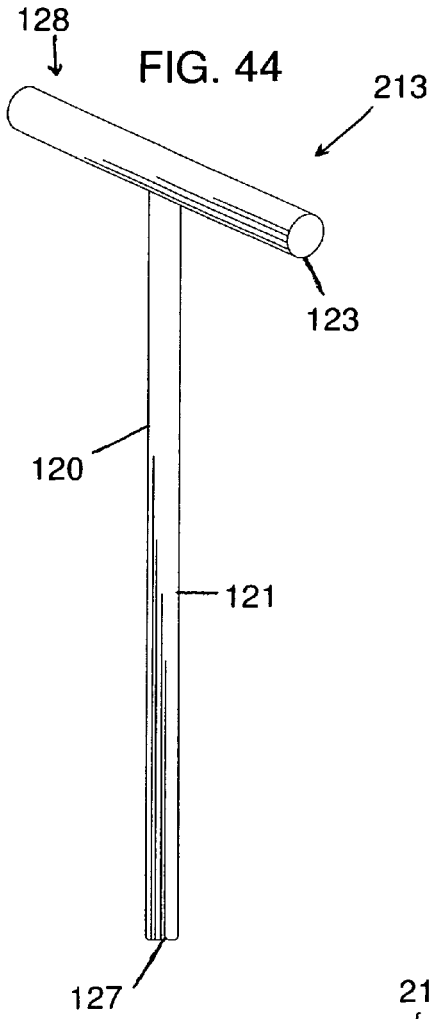
FIG. 44 is an oblique view of another form of the invention.
Figure 77:
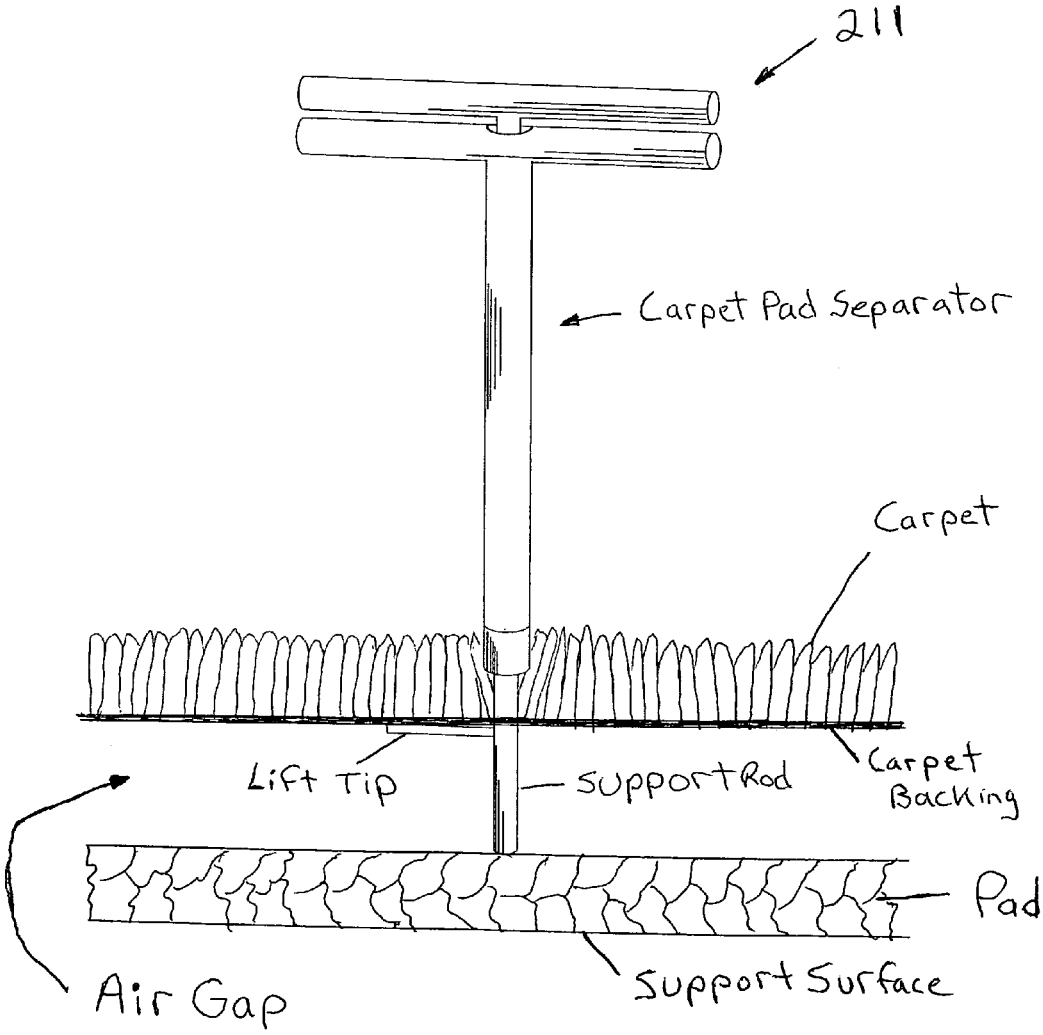
FIG. 77 is a schematic cross-sectional view of a vessel illustrating operation of the invention.

The separate embodiments in FIG. 41 and FIG. 44 shown as a unit together in FIG. 47 and also in related FIG. 35 both are oriented in ready to use fashion. The tool is held by the handle 103 and the lift tip body 101 is held substantially parallel to the carpet while the lift tip 102 is pointing down to the carpet. The user then spreads the carpet fibers to expose an opening in the carpet backing. The lift tip 102 is inserted down into the opening in the carpet backing and the tool is rotated to an upright position with the lift tip 102 still below the carpet backing. The handle 123 is inserted down fully to meet with handle 103 so that they are together as shown in FIG. 35 The carpet is now standing away from the pad as shown in FIG. 77 and an air gap space is achieved between the carpet and the pad to help facilitate drying and most importantly the air gap separation between the carpet and pad.

Figure 2:
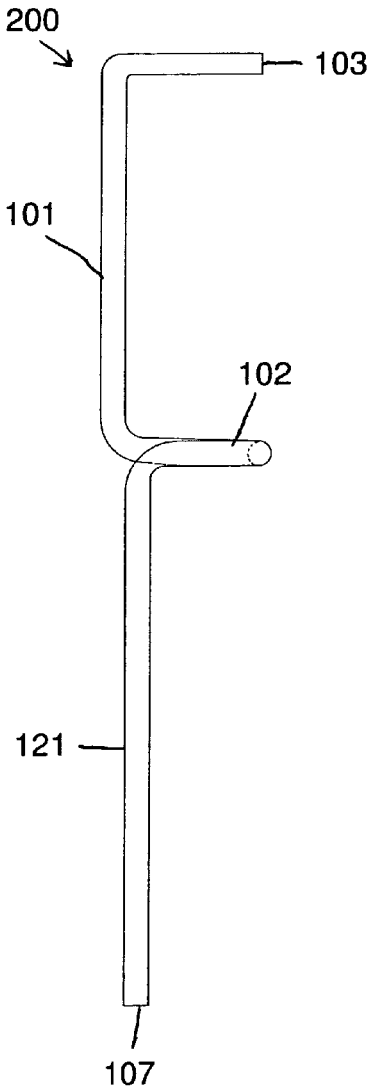
FIG. 2 is a right side view of the invention shown in FIG. 1.
Figure 3:
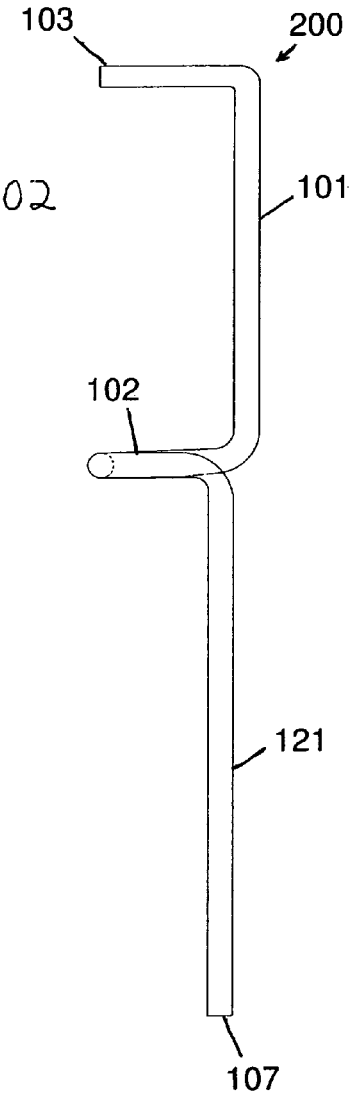
FIG. 3 is a left side view of the invention shown in FIG. 1.

In one particular form of the invention shown in FIGS. 1-3 The unit is a solid body one piece metal construction but is also envisioned as being made from other materials. The user holds the tool 200 by the body handle 103 and then the support rod tip 107 is inserted through an opening in the carpet backing so that the support rod 121 is at a right angle to the carpet face and lift tip 102 is parallel and kept in the same orientation as described. While the first support rod tip 107 is inserted a second lift tip body and support rod 200 body handle 103 tip is inserted through the carpet backing near the location of the first tool and is only used to lift the carpet into position. While the carpet is lifted up into position by the second tool, the first tool handle is then rotated in a fashion as to move the lift tip 102 into position under the carpet so that when the second tool is removed the carpet is resting on top of the lift tip 102 to create an air gap space to help facilitate drying and most importantly an air gap separation between the carpet and pad.

In another form of the invention shown in FIGS. 4-6 The unit is a solid body one piece metal construction but is also envisioned as being made from other materials. The user holds the tool 201 by the handle 103 and then the support rod tip 107 is inserted through an opening in the carpet backing so that the rod 121 is at a right angle to the carpet face and lift tip 102 is parallel to the carpet and kept in the same orientation as described. While the first support rod tip 107 is inserted in the carpet and a second lift tip body and support rod tool 201 handle tip 103 is inserted through the carpet backing near the location of the first tool and is only used to lift the carpet into position. While the carpet is lifted up into position by the second tool, the first tool handle is then shifted in a fashion as to move the lift tip 102 into position under the carpet so that when the second tool is removed the carpet is resting on top of the lift tip 102 to create an air gap space to help facilitate drying and most importantly an air gap separation between the carpet and the pad.

In another form of the invention shown if FIGS. 7-9 The lift tip embodiment 202 is shown as a solid body metal construction but is also envisioned as being made from other materials such as metals or plastics. The user grasp the body handle 103 and inserts the lift tip 102 into the carpet backing and then the tool is rotated into the upright position. While in the upright position the second part of this two piece tool shown in FIGS. 13-15 the support rod 203 also a solid body metal construction but is also envisioned as being made from other materials. The support rod tip 127 is inserted through a opening in the carpet backing adjacent to the lift tip 102 already inserted into position. The support rod 203 is then pushed straight down to the floor with the handle 123 while the longitudinal axis is kept at a right angle to the floor. The lift tip body 202 is then raised straight up by the handle 103 so that the lift rod eyelet 130 is then set on top of the support rod pin 122 so that the support rod pin 122 is inset into the eyelet 130 to retain the carpet in a lifted position to create the air gap separation between the carpet and pad.

In yet another form of the invention shown in FIGS. 10-12 The lift tip body 204 is shown as a solid body metal construction but is also envisioned as being made from other materials. The user grasps the lift handle 103 and inserts the lift tip 102 into the carpet backing and then the tool is rotated into the upright position. A second part of this two piece tool shown in FIGS. 13-15, is called a support rod 203, and is also a solid body metallic or plastic construction. The support rod tip 127 is inserted through a opening in the carpet backing adjacent to the lift tip 102 already inserted into position. The support rod 203 is then pushed straight down to the floor with the handle 123 while the longitudinal axis remains at a right angle to the floor. The lift rod 204 is then raised straight up by the handle 103 so that the lift rod eyelet 130 is then set on top of the support rod pin 122 so that the pin 122 is inset into the eyelet 130 to retain the carpet in a lifted position to create the air gap separation between the carpet and pad.

In another form of the invention shown in FIGS. 16-18 the lift rod 205 is shown as a solid body metal construction, but is also envisioned as being made from other materials. The user grasps the lift body handle 103 and inserts the lift tip 102 into the carpet backing and then the tool is rotated into the upright position. A second part of this two piece tool is shown in FIGS. 13-15, is called a support rod 203, and is also solid body metal construction but may also be made from other materials. The support rod tip 127 is inserted through the top of the lower eyelet opening 131. The support rod 203 is pressed down through an opening in the carpet backing adjacent to the lift tip 102 which is already inserted into position. The support rod 203 is then pushed straight down to the floor with the handle 123 while the longitudinal axis at a right angle to the floor. The lift tip body 205 is then raised straight up by the body handle 103 so that the lift tip body eyelet 130 is then set on top of the support rod pin 122 so that the pin 122 is inset into the eyelet 130 to retain the carpet in a lifted position to create the air gap separation between the carpet and pad.

In yet another form of the invention shown if FIGS. 19-21 The lift tip body 206 is shown as a solid body metal construction but is also envisioned as being made from other materials. The user grasps the body handle 103 and inserts the lift tip 102 into the carpet backing and then the tool is rotated into the upright position. The second part of this two piece tool shown in FIGS. 13-15, called the support rod 203, is also solid body metal construction, but may also be made from other materials. The support rod tip 127 is inserted through the top of the lower eyelet opening 131. The support rod 203 is pressed down through an opening in the carpet backing adjacent to the lift tip 102 already inserted into position. The support rod 203 is then pushed straight down to the floor with the handle 123 while the longitudinal axis at a right angle to the floor. The lift tip body 206 is then raised straight up by the handle 103 so that the lift rod eyelet 130 is then set on top of the support rod pin 122 so that the pin 122 is inset into the eyelet 130 to retain the carpet in a lifted position to create the air gap separation between the carpet and pad.

In another form of the invention shown in FIGS. 22-25 The lift tip body 208 is shown as a solid body metal construction but is also envisioned as being made from other materials. The user grasps the support rod handle 103 and inserts the lift tip 102 into the carpet backing and then the tool is rotated into the upright position. The second part of this two piece tool, shown in FIGS. 26-28, is called the support rod 207, and is a solid body metal construction, but may be constructed from other materials. The support rod tip 127 is inserted through the top eyelet opening 130 and inserted down and through the lower eyelet 131. The support rod 207 is pressed down through an opening in the carpet backing adjacent to the lift tip 102 already inserted into position. The support rod 207 is then pushed straight down to the floor with the handle 123 while the longitudinal axis is kept at a right angle to the floor. The lift tip body 208 is then raised straight up by the handle 103 so that the support rod handle 123 can rotate into position and inset under the lift rod latch hook 140 to retain the carpet in a lifted position to create the air gap separation between the carpet and pad.

In yet another form of the invention shown assembled together in FIGS. 35-37 their embodiments shown separately in FIGS. 29-34 and 38-40 The support rod 209 and the lift tip body 210 are assembled and manipulated by the user in essentially the same manner as previous forms of the invention were described. The support rod tip 127 is inserted into the cavity 106 on top of the lift body handle 103 and is now prepared for installation. The carpet pad separator manipulated as previous forms and installed on the carpet shown in FIG. 77 The carpet pad separator is used to facilitate drying and most importantly used to produce the air gap separation between the carpet and pad. Embodiments are made of similar constructions of metal and plastics and other materials may be used and or combined to assemble the carpet stand tool and may be made interchangeable. Some embodiments may be pre-assembled for use or field assembled at time of installation.

In another form of the invention shown assembled together in FIGS. 47-49, their embodiments shown separately in FIGS. 41-46, the support rod 213 and the lift tip body 214 are assembled and manipulated by the user in essentially the same manner as previous forms of the invention were described. The support rod tip 127 is inserted into the top cavity 106 of the lift tip body handle 103 and is prepared for installation. The carpet pad separator is manipulated as previous forms were described and installed on carpet as shown in FIG. 77. The carpet pad separator is used to facilitate drying and most importantly used to produce the air gap separation between the carpet and pad. Embodiments are made of similar constructions of metal and plastics and other materials previously described may be used and or combined to assemble the carpet stand tool. Lift tip assembly diagrams in FIGS. 68-76 depict a lift tip 102 that may be formed, then attached to the lift tip body 104 as shown in lift tip assembly 223, or may be made as one piece as shown in lift tip assembly 222 and 224. The lift tip 102 may be formed to or attached to many positions on the diameter along the lift tip body 104.

In another form of the invention shown in FIGS. 50-61 The support rod 117 and 119 and the lift tip body 116 and 118 are shown with L-shaped handles to help facilitate ease of engagement with the carpet as not to interfere with the handle movement. These forms of the invention are assembled and manipulated by the user in essentially the same manner as previous forms of the invention were described. The support rod bottom tip 127 is inserted in the top cavity 106 of the lift tip body handle 103. Embodiments are made of similar constructions of metal and plastics and other materials previously described may be used and or combined to assemble the carpet stand tool. Lift tip assemblies 222, 223, and 224 shown in diagram FIGS. 68-76 may be formed then attached to the lift tip body 101 or formed on the lift tip body 104

In another form of the invention shown in FIGS. 62-67 The support rod 221 and the lift tip body 220 are assembled and manipulated by the user in essentially the same manner as previous forms of the invention were described. The support rod tip 127 is inserted in the top cavity 106 of the lift tip body 101 and is prepared for installation. The carpet pad separator is used to facilitate drying and most importantly used to produce an air gap separation between the carpet and the pad as shown in FIG. 77. Embodiments are made of similar constructions of metal and plastics and other materials may be used and or combined to assemble the carpet stand tool and may be made interchangeable. Some embodiments may be pre-assembled for use or field assembled at time of installation. Some carpet stand tools are intended for reuse while others may be intended for one time use and discarded.

The invention claimed is:

1. A carpet pad separator for creating a separation between a carpet and its underlying substrate thereby preventing wicking of a substance contained on the substrate into the carpet, the apparatus comprising;

a lifting body containing a lifting tip extending away from said lifting body at a substantially perpendicular angle to a longitudinal axis of said lifting body, said lifting tip located at an first end of said lifting body, and sized to pass through the weave of the backing of a carpet;

a body handle attached to and extending from a second and opposite end of said lifting body at a substantially perpendicular angle to said lifting body's longitudinal axis;

a support rod having as straight support rod tip located at a first end of the support rod, said straight support rod tip sized to pass through the backing of the carpet's weave, passed through an annular retention feature on said lifting body, and oriented to lie substantially parallel with said lifting body's longitudinal axis;

a support handle attached to and extending from a second and opposite end of said support rod at a substantially perpendicular angle to a longitudinal axis of said support handle;

wherein said support rod tip may be extended away from said first lifting tip engaging the underlying supporting substrate thereby separating the carpet from the underlying substrate.

2. The carpet pad separator as defined in claim 1, wherein said lifting body's annular retention feature further comprises a hollow tubular portion receiving and supporting a section of said support rod.

3. The carpet pad separator as defined in claim 1, wherein said body handle further comprises a mechanical latch adapted to engage and retain said support rod in an extended position.

4. The carpet pad separator as defined in claim 1, wherein said lifting body is tubular.

5. The carpet pad separator as defined in claim 1, wherein said straight support rod tip lies parallel to a longitudinal axis of said lifting body.

6. The carpet pad separator as defined in claim 1, wherein said support rod is received through an interior passage passing through the entirety of said lifting body.

7. The carpet pad separator as defined in claim 1, wherein said support rod passes through a guide eyelet located on an exterior surface of said lifting body.

8. The carpet pad separator as defined in claim 1, wherein said lifting tip is detachable from said lifting body.

9. A carpet-pad separator for creating an air gap between a carpet and its underlying substrate thereby preventing wicking of a substance contained on the substrate into the carpet, the apparatus comprising:

a hollow lifting body containing a detachable lifting tip extending away from said lifting body at a substantially perpendicular angle to a longitudinal axis of said lifting body, said detachable lifting tip located at an first end of said lifting body and sized to pass through the weave of the backing of a carpet;

a body handle attached to and extending from a second and opposite end of said lifting body at a substantially perpendicular angle to said lifting body's longitudinal axis;

a support rod fitted inside said hollow lifting body and having a straight support rod tip located at a first end of the support rod, said support rod tip sized to pass through the weave of the backing of the carpet, said straight support rod tip lying substantially co-axial with said hollow lifting body's longitudinal axis;

a support handle attached to and extending from a second and opposite end of said support rod at a substantially perpendicular angle to a longitudinal axis of said support handle;

wherein said straight support rod tip extends away from said first lifting tip as body handle is brought nearer to said support handle, thereby engaging the underlying supporting substrate thereby separating the carpet from the underlying substrate as the handles are brought proximate to one another; and said body handle containing a latch which engages said support handle retaining the support rod in an extended position.

10. The carpet pad separator as defined in claim 9, wherein said support handle is 'L' shaped.

11. The carpet pad separator as defined in claim 9, wherein said body handle is 'L' shaped.

12. The carpet pad separator as defined in claim 9, wherein said support handle is 'T' shaped.

13. The carpet pad separator as defined in claim 9, wherein said body handle is 'T' shaped.

14. The carpet pad separator as defined in claim 7, wherein said body handle contains a latch to retain said support rod in an extended position.

15. A carpet pad separating apparatus for preventing a substance in a carpet pad from wicking into an overlying carpet, comprising:

a lifting body containing a lifting tip on a first end, said lifting tip passed through a backing of a carpet;

said lifting body further comprising a second opposite end to which a body handle is attached:

a support rod, passed through an annular retention feature located on said lifting body, further comprising a support rod shaft having a length longer than said lifting body, a straight support rod tip located on a first end of said support rod shaft, and a support rod handle located on a second and opposite end of said support rod shaft;

wherein said lifting tip is located on an exterior surface of said lifting body, extends away from said body at a substantially perpendicular angle relative to a longitudinal axis of said lifting body, and engages said backing of said carpet;

a longitudinal axis of said support rod lying substantially co-axial with said longitudinal axis of said lifting body's substantially hollow core; and wherein said straight support rod tip engages a carpet pad and separates said carpet pad from said backing of said carpet.

16. The carpet pad separating apparatus of claim 15, further comprising an external eyelet located on said lifting body, wherein said support rod is fitted through said eyelet.

17. The carpet pad separating apparatus of claim 15, further comprising:

said lifting body further having a substantially hollow core located along said longitudinal axis, wherein said support rod is fitted through said substantially hollow core.

18. The carpet pad separating apparatus of claim 15, further comprising a latch mounted on said body handle engaging said support handle and retaining said support rod in an extended position.

19. The carpet pad separating apparatus of claim 15, wherein said lifting tip is detachable.

* * * * *